US009669914B1

(12) United States Patent
Hundertmark

(10) Patent No.: US 9,669,914 B1
(45) Date of Patent: Jun. 6, 2017

(54) MARINE POWER STEERING SYSTEM

(71) Applicant: Mark X Steering Systems, LLC, Devils Lake, ND (US)

(72) Inventor: James M. Hundertmark, Fond du Lac, WI (US)

(73) Assignee: MarineTech Products, Inc., Vadnais Heights, MN (US)

( * ) Notice: Subject to any disclaimer, the term of this patent is extended or adjusted under 35 U.S.C. 154(b) by 0 days.

(21) Appl. No.: 14/873,801

(22) Filed: Oct. 2, 2015

Related U.S. Application Data

(60) Provisional application No. 62/059,213, filed on Oct. 3, 2014.

(51) Int. Cl.
*B63H 20/08* (2006.01)
*B63H 20/12* (2006.01)

(52) U.S. Cl.
CPC ..... *B63H 20/12* (2013.01)

(58) Field of Classification Search
CPC ..... B63H 20/12
See application file for complete search history.

(56) References Cited

U.S. PATENT DOCUMENTS 5,241,894 A * 9/1993 Hundertmark ..... B63H 20/12 440/60
7,681,513 B1 * 3/2010 Hundertmark ..... B63H 20/12 114/144 R

* cited by examiner

*Primary Examiner* — Stephen Avila
(74) *Attorney, Agent, or Firm* — Boyle Fredrickson, S.C.

(57) ABSTRACT

A power steering system for a marine steering includes a hydraulic cylinder, an actuator block that is mounted on an outer end of a ram of the cylinder, and valving. An actuator arm, mounted on the actuator block, is connected to the steering link, to the steering rod, and to the valving. The actuator arm is configured to move on the actuator block upon the transmission of steering command forces thereto by the steering rod to actuate the valving so as to drive the ram into or out of the barrel and to transmit steering forces to the steering link from the actuator block. The actuator block is configured such that it can accept standard steering links of different engine brands.

16 Claims, 6 Drawing Sheets

MARINE POWER STEERING SYSTEM

CROSS REFERENCE TO RELATED APPLICATION

The present application claims priority under 35 U.S.C. §119(e) to U.S. Provisional Patent Application Ser. No. 62/059,213, filed Oct. 3, 2014 and entitled Marine Power Steering System, the contents of which are hereby incorporated by reference in their entirety.

BACKGROUND OF THE INVENTION

I. Field of the Invention

The invention relates to marine power steering systems and, more particularly, to a hydraulically-actuated marine power steering system providing pressurized hydraulic fluid for the system. The invention additionally relates to an improved and more versatile actuator assembly for such a system.

II. Description of Related Art

Typically, marine power steering systems for outboard motors and stern drives utilize an extendible and contractible steering ram or rod connected to the boat transom and to the propulsion unit. Extension and contraction of the piston ram in the steering link causes the propulsion unit to pivot and steer the boat. Such units require a rather large hydraulic pump since rather large volumes of hydraulic fluid are required if the steering is moved rapidly from one side to the other. Such systems also require that the engine be running in order for the steering system to operate since the hydraulic pump is powered by the engine. Two such systems are still in use today. One of the systems uses a continuous running electric powered pump which requires a high output electrical charging system to keep the system's battery charged. Most engines in the marketplace do not possess an adequate charging system which limits the use of such a system. The second system uses an electrically-powered pressure amplifier that is placed between a standard hydraulic helm and a steering cylinder on the engine. The pressure amplifier turns on and off every time a steering input is generated. The power requirement of this system is not as severe as the continuous running pump, but it is significant.

Both systems have a limited maximum volume output. In a rapid steering situation, the volume of fluid needed to steer the engine exceeds the maximum volume output of the power supply. The effect of power steering thus can be lost.

To help counter this effect, helms were designed to increase the number of steering wheel turns required to steer the engine from one side to the other. A traditional "three-turn system" requiring three steering turns to maximize the helm's steering angle now requires four or five turns. The requirement for additional turns makes it more difficult for the operator to overrun the output of the power supply. However, system responsiveness is degraded, hindering docking or other precise maneuvers.

More recently, systems have been introduced that use an accumulator to store pressurized hydraulic fluid, permitting the use of smaller pumps requiring less power. Such a system is disclosed in U.S. Pat. No. 5,241,894 (the '894 patent). The system disclosed in the '894 patent includes a pump that provides pressurized hydraulic fluid from a reservoir and a control system to selectively place the pump in an operative or inoperative mode. The hydraulic system is also provided with a valve that selectively provides pressurized hydraulic fluid to a hydraulic cylinder to cause extension or retraction of the piston ram in the cylinder. The valve is provided with ball-type check valves to control the hydraulic flow rather than using a spool-type valve which by its very nature allows for some leakage. The system can operate even when the engine is not operating, which eliminates the need for a large and continuously operating hydraulic pump.

The system disclosed in the '294 patent and later, commercial versions of that system work well, but they are designed to fit one brand of engine, namely, Mercury Marine. They are not easily usable with other brands such as Bombardier (including Eveinrude and Johnson) Honda, Yamaha, and Suzuki.

Another problem associated with the system disclosed in the '294 patent and commercial version of that system is that they require the use of relatively unreliable seals.

Thus, there remains room for improvement.

SUMMARY OF THE INVENTION

In accordance with an aspect of the invention, a power steering system for a marine steering system can be installed on many if not all major brands of outboard marine engines and some stern drives. The power steering system also is more reliable than prior art systems because it has a more reliable sealing arrangement. The power steering system includes 1) a hydraulic cylinder having a barrel and a ram that moves into and out of one end of the barrel, 2) an actuator block that is mounted on an outer end of the ram, and 3) valving that is located in the hydraulic cylinder and that is configured to control the flow of hydraulic fluid to and from the hydraulic cylinder. An actuator arm, mounted on the actuator block, is operatively connected to the steering link, to the steering rod, and to the valving. The actuator arm is configured to move on the actuator block upon the transmission of steering command forces thereto by the steering rod to actuate the valving so as to drive the ram into or out of the barrel and to transmit steering forces to the steering link from the actuator block.

The actuator block is configured such that it can accept standard steering links of different engine brands.

The actuator arm may be mounted on the actuator block so as to be pivotable about a generally central portion thereof. It has a first end portion, a second end portion connected to the steering rod, and a steering link connector located between the first and second end portions. The actuator arm may be mounted within an elongated groove in the actuator block, and a clearance between the actuator arm and an edge of the groove may determine the maximum pivoting stroke of the actuator arm and a resultant maximum degree of valve opening.

A valve actuator ram, a yoke, and an actuator pin may be located on the actuator block, with the valve actuator ram being configured to actuate the valving, the yoke engaging the actuator pin, and the actuator pin being mounted on the first end portion of the actuator arm and engaging the yoke. An end of the valve actuator ram may be attached to the yoke in an adjustable matter that allows the position of the yoke relative to the actuator arm to be adjusted after the hydraulic steering cylinder is fully assembled.

A valve actuator ram may be located in a bore the actuator block so as to be movable under operation of the actuator arm to actuate the valving. The valve actuator ram is sealed to the bore in the actuator block by an o-ring seal.

These and other features and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications

BRIEF DESCRIPTION OF DRAWINGS

Preferred exemplary embodiments of the invention are illustrated in the accompanying drawings, in which like reference numerals represent like parts throughout, and in which.

DETAILED DESCRIPTION

Figure 1:
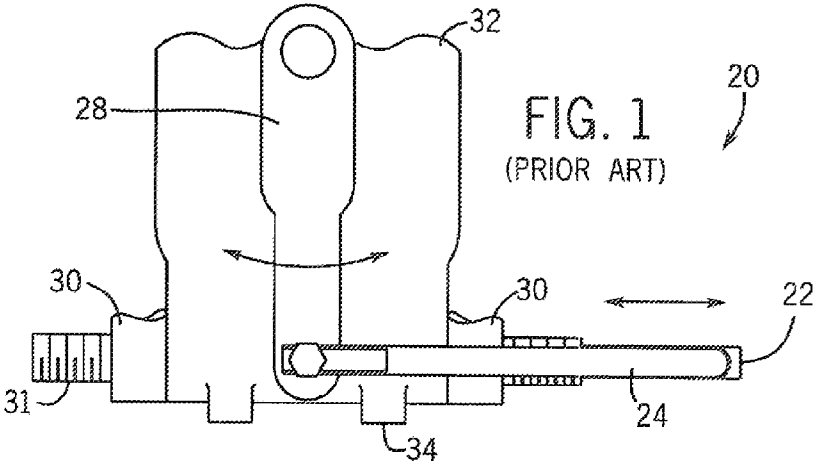
FIG. 1 (PRIOR ART)
FIG. 1 is a top plan view of a portion of a standard cable steering system, appropriately labeled "PRIOR ART"
Figure 2:
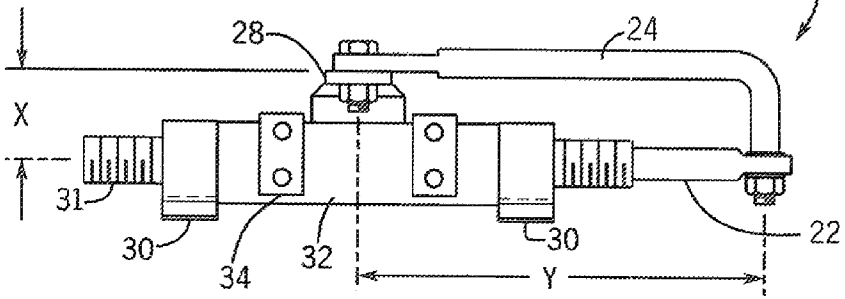
FIG. 2 (PRIOR ART)
FIG. 2 is a front elevation view of a standard cable steering system, appropriately labeled "PRIOR ART"
Figure 3:
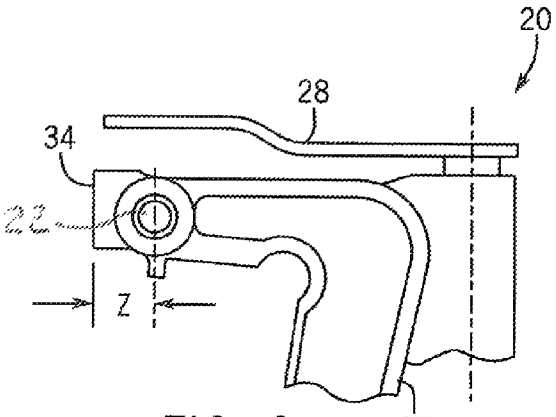
FIG. 3 (PRIOR ART)
FIG. 3 is a side elevation view of a standard cable steering system, appropriately labeled "PRIOR ART"

Turning now to the drawings and initially to FIG. 1, a cable steering system 20 constructed in accordance with the prior art includes a steering cable output ram or steering rod 22 and a steering link 24. The steering link 24 is coupled to the steering rod 22 at one end and to a marine engine steering arm 28 at its opposite end. FIG. 2 shows the height (x) of the attachment point of the steering link 24 to the centerline of the steering cable output ram or steering rod 22 and a dimension (y) designating the longitudinal extent of the steering link 24. Steering link 24 generally corresponds in function to the "linkage" shown at 18 in the '894 patent. Dimension (x) varies for different brands of engines. Also shown in FIGS. 1 and 2 are an engine tilt tube 31 and a swivel mount bracket or swivel mount 32. Dimension (y) remains approximately the same for all major brands of engines. FIG. 3 shows a side view of transom brackets 30 and swivel bracket or swivel mount 32 via which the engine power steering system is mounted on a boat. The dimension (z) is the distance from the centerline of the steering rod 22 to the mounting surface of a power steering mounting location 34 on the swivel mount 32 on which the power steering system (not shown) is mounted. Dimension (z) varies for different brands of engines. Because dimensions (x) and (z) vary between engine brands, a different steering link 24 having a different length and/or orientation is needed for each brand of engine.

In contrast, FIGS. 4-14 illustrate a cable steering system 50 having a power steering system 52 that is usable with most, if not all, major marine engine brands. One such engine is the outboard motor 51 shown as being mounted on the transom 54 of a boat by transom mounts 56. As is typical, a stationary swivel mount 58 is mounted on the exterior surface of the transom 54 by the transom mounts 56. The motor 51 is supported on a pivot shaft 60 located behind the transom 54 and can tilt about a horizontal axis by moving about a horizontal engine tilt tube 67. Shaft 60 is rotatably supported on the swivel mount 58 and is driven to rotate about a generally vertical axis by a steering arm 62. The steering arm 62 is driven by the cable steering system 50 and/or the power steering system 52. Steering commands are generated by a steering mechanism 64 such as a steering wheel coupled indirectly to the steering arm 62 by a cable 66, a steering rod 68, and a steering link 69. The steering system 50 thus can be considered a "cable steering system", though the invention is also applicable to systems actuated by linkages and devices other than cables and can be used with marine propulsion systems other than outboard motors.

Figure 4:
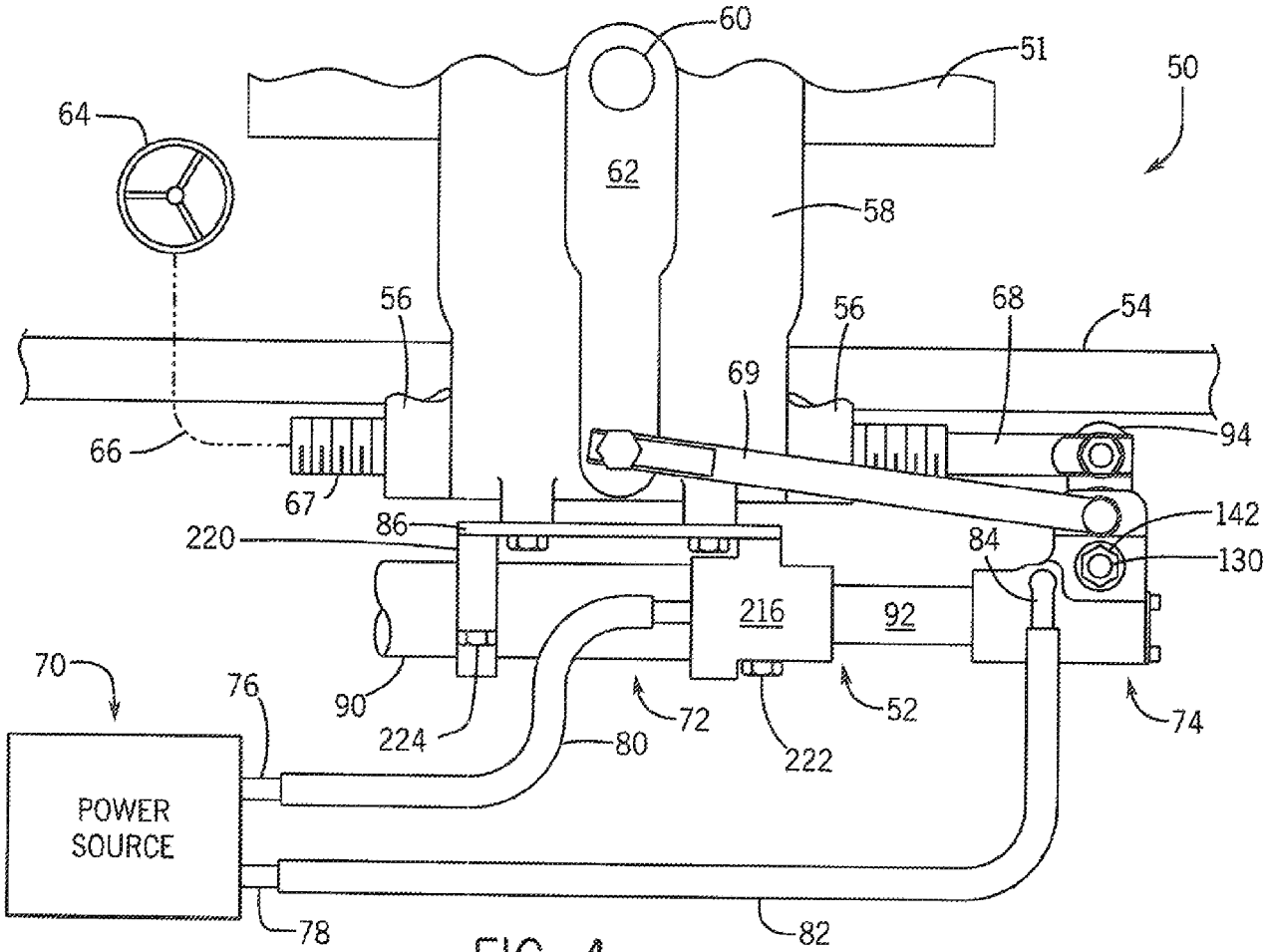
FIG. 4 is a partially schematic top plan view of a cable steering system incorporating a power steering system constructed in accordance with the present invention.

Referring to FIG. 4, the power steering system 52 includes a power source 70, a hydraulic cylinder or steering cylinder 72, and an actuator block 74. The power source 70 is mounted in the boat in the vicinity of the motor 51. It typically comprises an integrated pump/reservoir having a pressurized fluid outlet 76 coupled to the outlet of an internal pump and an unpressurized inlet 78 that opens into the reservoir. The outlet 76 delivers hydraulic fluid to the cylinder 72 via a supply hose 80, and the inlet 78 receives fluid via a return hose 82 coupled to a port 84 on the actuator block 74. The remainder of the power steering system 52 is mounted on a front end of the swivel mount 58 via a universal mounting bracket assembly 86, detailed below.

Figure 7:
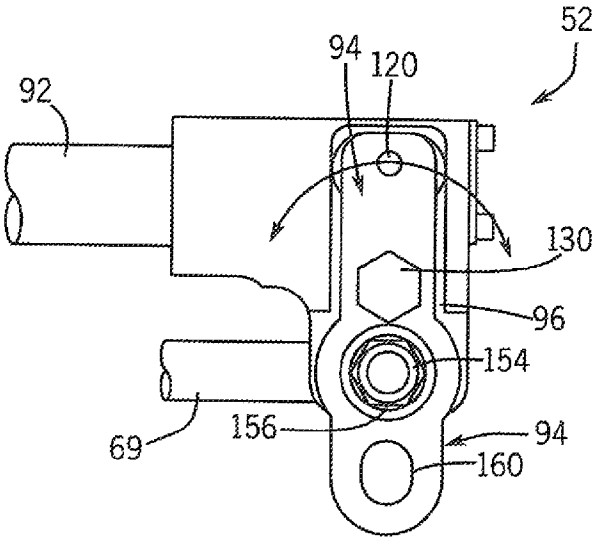
FIG. 7 is a bottom plan view of the actuator block of the power steering system of FIG. 4 and the attached steering link.
Figure 5:
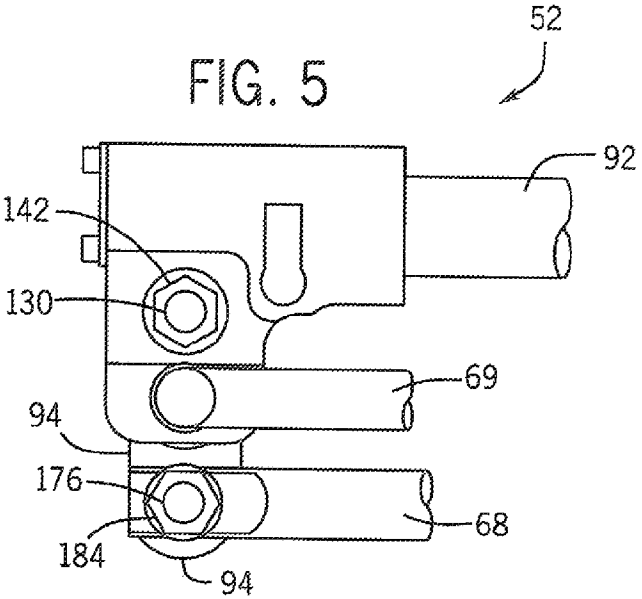
FIG. 5 is a top plan view of an actuator block of the power steering system of FIG. 4 and the attached linkage.
Figure 6:
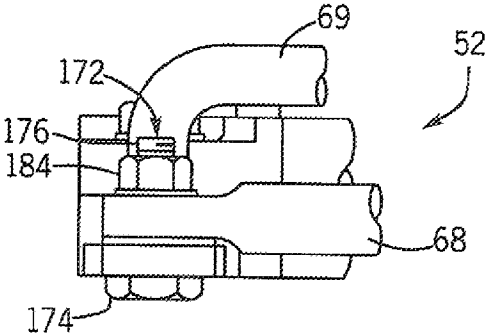
FIG. 6 is a front elevation view of the actuator block of the power steering system of FIG. 4 and the attached linkage.

The hydraulic cylinder 72 includes a barrel 90 and a ram 92. Ram 92 extends from and retracts into the barrel 90 under the flow of hydraulic fluid to and from the hydraulic cylinder 72. The barrel 90 is fixedly mounted on the swivel mount 58 by the universal mounting bracket assembly 86 as discussed below in conjunction with FIGS. 13 and 14. One end of the actuator block 74 is mounted on the end of the ram 92. Referring to FIGS. 5-7, an actuator arm 94, extending from the opposite end of the actuator block 74, is coupled to an output end of the steering rod 68. The first or input end of the steering link 69 is connected to the actuator arm 94 between the mounting point for the steering rod 68 and the opposite end that is mounted on the ram 92. Valving 102 (FIG. 9) controlling hydraulic fluid flow into and out of the hydraulic cylinder 72 is contained within the hydraulic cylinder 72.

In operation, steering command forces are transmitted to the actuator block 74 by the steering wheel 64, cable 66, and steering rod 68. These steering command forces pivot the actuator arm 94 on the actuator block 74 to actuate the internal valving in the hydraulic cylinder 72 to drive the ram 92 into or out of the barrel 90 of the hydraulic cylinder 72. The resultant linear movement of the actuator block 74 is translated into pivotal movement of the steering arm 62 and the motor 51 through the steering link 69. These power steering forces may be supplemented by or, in the event of failure of the power steering system 52, replaced by manual steering forces imposed on the steering arm 62 by the steering rod 68.

Figure 9:
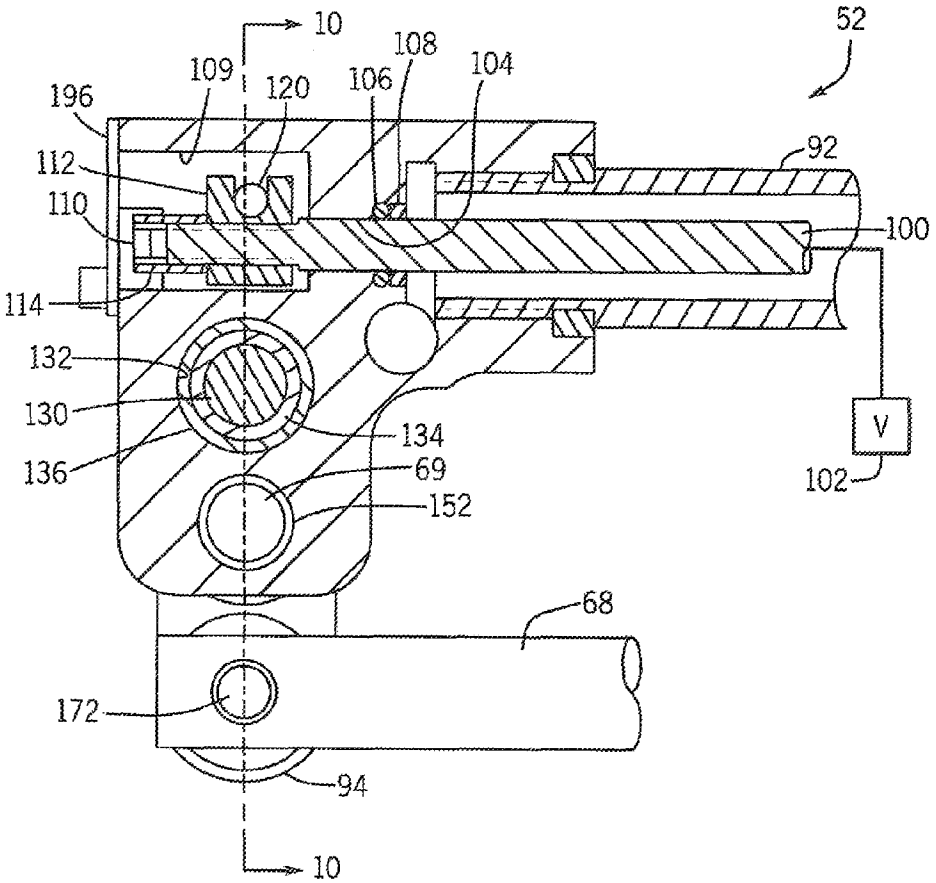
FIG. 9 is sectional view of the actuator block of the power steering system of FIG. 4, taken generally along the lines 9-9 in FIG. 8.
Figure 8:
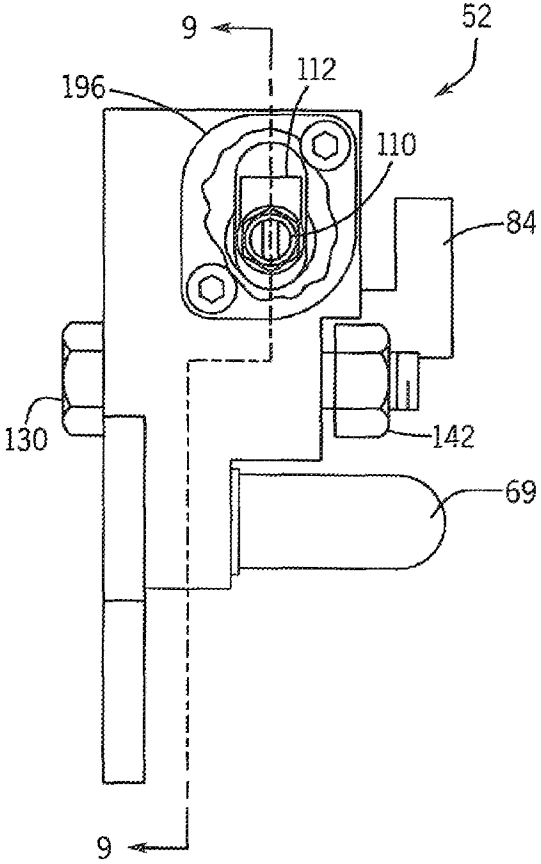
FIG. 8 is an end elevation view of the actuator block of the power steering system of FIG. 4 and the attached steering link.

Referring to FIG. 9, valve actuator ram 100 extends into the hydraulic cylinder 72 and corresponds to the contractible piston ram 16 of the '894 patent. Its inboard end (not shown) actuates the valving 102 in the hydraulic cylinder 72. In the system disclosed in the '894 patent, the return fluid is sealed by a flexible seal around the control stem. That seal is shown as a flexible sleeve 186 in U.S. Pat. No. 5,241,894 and described, e.g., at Col. 5, lines 4-17. This type of seal is prone to failure if the fluid return line becomes restricted due, for example, being kinked or being subjected an increase in fluid viscosity therethrough at low operating temperatures. The pressure on the seal could equal the maximum operating pressure of the system. FIG. 9 shows that the return fluid in the inventive system is sealed in a stepped bore 104 in the actuator block 74 not by a flexible sleeve but by an o-ring 106 around the valve actuator ram 100. The o-ring 106 is held in place within the bore 104 by a washer 108. This type of sealing arrangement can withstand the maximum fluid pressure in the system.

Still referring to FIG. 9, the valve actuator ram 100 passes through the bore 104 in the actuator block 74 and into an interior chamber 109 on the opposite side of the actuator block 74. The end of the actuator ram 100 is threaded, and has a slot 110 formed therein. The slot 110 allows the actuator ram 100 to be turned to thread onto a yoke 112 and a lock nut 114 located in chamber 109. This arrangement allows the yoke 112 to be moved to center the actuator arm 94 in the groove 96 after the steering cylinder 72 is fully assembled. This is in contrast to the system disclosed in the '894 patent, in which the actuator ram 18 needs to be locked in position before the steering cylinder 72 is assembled. There is no allowance for further adjustment.

Figure 10:
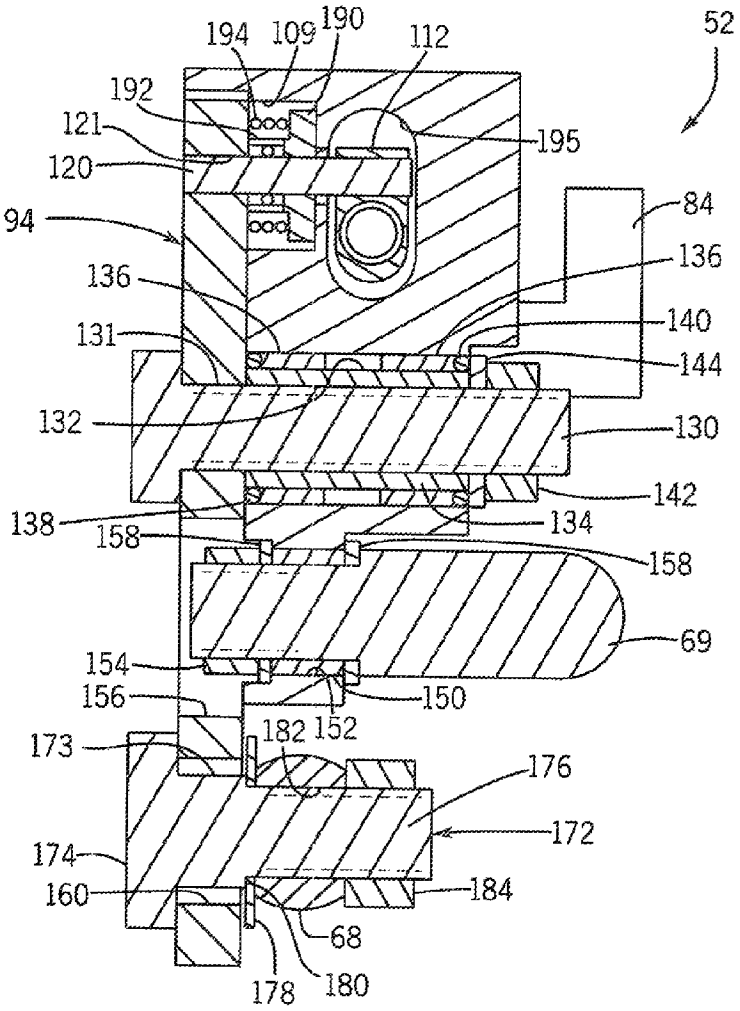
FIG. 10 is sectional view of the actuator block of the power steering system of FIG. 4, taken generally along the lines 10-10 in FIG. 9.

FIG. 10 is a sectional view of the actuator block 74, taken through the center line of the actuator arm 94 per lines 10-10 in FIG. 9. Referring to that figure, an actuator pin 120 extends from a bore 121 in the actuator arm 94 and into the yoke 112. The actuator pin 120 is attached to the actuator arm 94 so that, when the steering rod 68 is moved, the actuator pin 120 moves the yoke 112 in the opposite direction. Yoke 112 moves the valve actuator ram 100, which opens the valving 102 in the steering cylinder 72. This causes the actuator block 74 to move in the same direction as the steering rod 68, which pivots the steering arm 62 and steers the motor 51. When the steering rod 68 stops moving, the actuator block 74 will continue to move until the valving in the steering cylinder 72 closes.

Referring to FIGS. 4-10, the actuator arm 94 pivots about a fastener bolt 130 extending through a bore 131 in the actuator arm 94 and a mating bore 132 in the actuator block 74 from above. Referring to FIGS. 9, and 10, the fastener bolt 130 is surrounded by a sleeve 133 that is supported in the bore 134 by two bushings 136. First and second o-ring seals 138 and 140 are provided opposite both ends of the sleeve 133 to prevent any debris from contaminating the bushings 136. A nut 142 and washer 144 fasten the actuator arm 94 to the sleeve 133 to hold the actuator arm 94 in place on the actuator block 74 while still allowing the actuator arm 94 to pivot relative to the actuator block 74.

Also as shown in FIG. 10, the steering link 69 passes through a bushing 150 housed in a bore 152 in the actuator block 74. The steering link 69 is fastened to the actuator block 74 by a nut 154 received in a bore 156 in the actuator arm 94 and serving as a steering link connector. The bore 156 is oversized to allow access to the nut through the actuator arm 94. A washer 158 is provided on each side of the attachment point between the steering link 69 and the actuator block 74 for reducing wear. Referring briefly to FIG. 1, the standard location for attaching the steering link 69 to the steering rod in prior art systems is where the stepped bolt 172 (described below) of this embodiment is located. The new attachment location according to this embodiment of the invention is now just behind its standard location and at the same height as the standard mounting location. This positioning allows for the use of a stock steering link 69 for most brands of engine because the attachment method and the geometry of the attachment of the steering link 69 to the steering cable output rod is the same for all major brands of engines.

Referring again to FIGS. 4 and 6-10, the steering rod 68 is attached to a slot 160 in the second end of the actuator arm 94 by a stepped bolt 172. Stepped bolt 172 has a larger diameter head 174 and a smaller diameter threaded portion 176. The larger diameter head 174 of the bolt 172 is positioned outside of and is larger than the slot 160 in the actuator arm 94. The bolt 172 has a shank portion 173 beneath the head whose diameter is slightly smaller than the width of the slot 160 in the actuator arm 94. A washer 178 rests on a shoulder 180 of the bolt 172. The smaller threaded diameter section 176 of the bolt 172 passes through a bore 182 in the end of the steering rod 68. The assembly is fastened together with a nut 184. Because of the height of the shoulder 180, and because the width of the slot 160 in the actuator arm 94 is larger than shank 173 of the bolt 172, movement is allowed between the bolt 172 and the actuator arm 94.

Also shown in FIG. 10 is a pocket 195 that is located inboard of the chamber 109 and that receives the yoke 112. The actuator pin 120 extends through the chamber 109 and into the pocket 109, where it is attached to the yoke 112. A face seal 190 in the chamber 109 fits over the actuator pin 120. An o-ring 192 forms a seal between the face seal 190 and the actuator pin 120. A spring 194 forces the face seal 190 against a passage leading into the pocket 195 to seal pocket 195 from chamber 109. The outer surface of chamber 109 is sealed by a cover 196.

Referring now to FIG. 7, which is a bottom view of the actuator block 7, a clearance between the edge of the groove 96 in the actuator block 74 and the side of the arm 94 bearing the actuator pin 120 determines the maximum pivoting stroke of the actuator arm 94. This travel range determines the maximum stroke of the valve actuator ram 100 and the maximum extent of valve opening. The actuator arm 94 can be replaced with one whose actuator pin end is narrower or wider than that of actuator arm 94 to optimize the maximum rate of movement of the system for a particular system.

Figure 11:
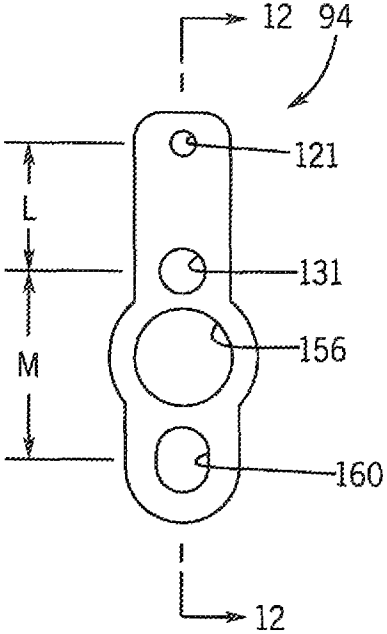
FIG. 11 is a top plan view of an actuator arm assembly of the power steering system of FIG. 4.

FIG. 11 is a top view of the actuator arm 94, showing dimensions (L) and (M). Dimension (L) is the distance between the center of bore 121 and the pivot point of the actuator arm 94, as determined by the center of the bore 131 that receives bolt 130. Dimension (M) is the distance from the pivot point of bore 131 and the attachment point for the steering rod 68 within slot 160. Dimension (M) is specific to each engine brand and varies for different brands of engines. Dimension M is always larger than dimension (L), which results in use in the generation of an actuating force that is less than the spring force used to seal the valves in the cylinder piston 72. This proportional relationship results in a decreased force needed to activate the system. In a system as described in the '294 patent, on the other hand, the opposite is true. In addition, because the actuator arm 94 is not exposed to return fluid, it can be easily replaced with an actuator arm optimized for a different engine brand.

Figure 13:
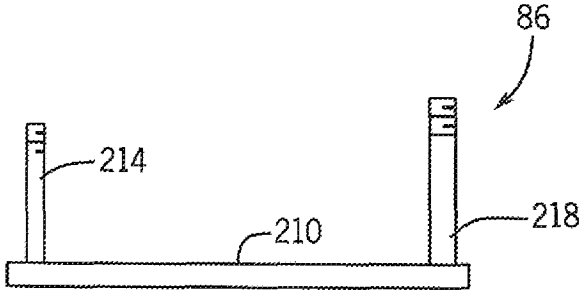
FIG. 13 is a top plan view of the power steering cylinder mounting bracket of the power steering system of FIG. 4.
Figure 14:
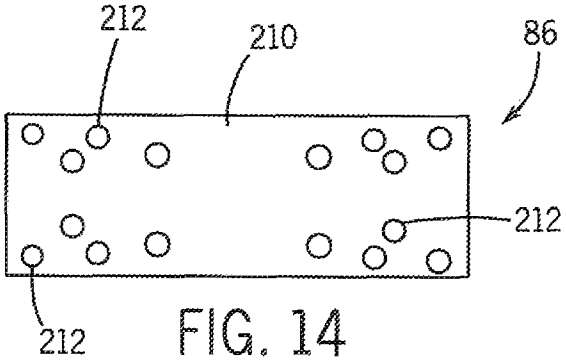
FIG. 14 is side elevation view of the power steering cylinder mounting bracket of the power steering system of FIG. 4.
Figure 12:
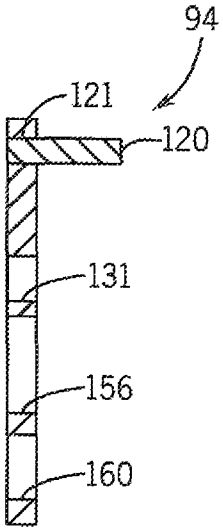
FIG. 12 is sectional view of the actuator arm assembly of the power steering system of FIG. 4, taken generally along the lines 12-12 in FIG. 11.

FIGS. 13 and 14 show the universal mounting bracket assembly 86 used to mount the cable power system 52 on the swivel mount 58. Universal mounting bracket assembly 86 comprises a flat plate 210 with multiple mounting holes 212 to accommodate the standard mounting bolt patterns of several different brands of engines. Referring to FIGS. 4 and 13, a first set of studs 214 passes through a steering cylinder and an end cap 216 for fastening the steering cylinder 72 to the mounting bracket assembly 86. A second set of studs 218 passes through a clamp 220 which attaches to the other end of the steering cylinder 72, to the bracket assembly 86. Nuts 222 and 224 (FIG. 4) are used to clamp the steering cylinder 72 to the mounting bracket assembly 86. This mounting system minimizes the spacing between the cylinder 72 and the swivel mount 58, which reduces the amount of clearance needed in front of the swivel mount 58 to mount the motor 51. This facilitates assembly and renders the system usable with a wider range of designs.

Although the best mode contemplated by the inventor of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the appended claims and other attachments.

I claim:

1. A power steering system for a marine steering system, the marine steering system comprising a pivotable outboard motor and a steering actuator operationally coupled to the outboard motor via a steering rod and a steering link, the power steering system comprising:

a. a hydraulic cylinder having a barrel and a ram that moves into and out of one end of the barrel;

b. an actuator block that is mounted on an outer end of the ram;

c. valving that is located in the hydraulic cylinder and that is configured to control the flow of hydraulic fluid to and from the hydraulic cylinder; and d. an actuator arm that is mounted on the actuator block and that is connected to the steering link, to the steering rod, and to the valving, the actuator arm being configured to move on the actuator block upon the transmission of steering command forces thereto by the steering rod to actuate the valving so as to drive the ram into or out of the barrel and to transmit steering forces to the steering link from the actuator block, wherein a valve actuator ram is located in a bore in the actuator block and is movable under operation of the actuator arm to actuate the valving, the valve actuator ram being sealed to the bore in the actuator block by an o-ring seal.

2. The power steering system of claim 1, wherein the actuator block is configured such that it can accept standard steering links of different engine brands.

3. The power steering system of claim 1, wherein the actuator arm is mounted on the actuator block so as to be pivotable about a generally central portion thereof and has a first end portion, a second end portion connected to the steering rod, and a steering link connector located between the first and second end portions.

4. The power steering system of claim 3, wherein the actuator arm is mounted within an elongated groove in the actuator block, and wherein a clearance between the actuator arm and an edge of the groove determines the maximum pivoting stroke of the actuator arm and a resultant maximum degree of valving opening.

5. The power steering system of claim 3, further comprising a valve actuator ram, a yoke, and an actuator pin located in the actuator block, the valve actuator ram being configured to actuate the valving, the yoke engaging the actuator pin, and the actuator pin being mounted on the first end portion of the actuator arm and engaging the yoke.

6. The power steering system of claim 5, wherein an end of the valve actuator ram is attached to the yoke in an adjustable manner that allows the position of the yoke relative to the actuator arm to be adjusted after the hydraulic steering cylinder is fully assembled.

7. The power steering system of claim 3, wherein the marine steering system further comprises a swivel mount having a front end, and further comprising a universal bracket via which the hydraulic cylinder is mounted on the front end of the swivel mount, the universal bracket having mounting locations arranged to accommodate different sized and shaped swivel mounts.

8. The power steering system of claim 1, wherein the actuator arm has a bore formed therethrough that allows access to a nut attaching the steering rod to the actuator block, the bore having a larger diameter than a diameter of the nut.

9. A power steering system for a marine steering system, the marine steering system comprising a pivotable outboard motor and a steering actuator operationally coupled to the outboard motor via a steering rod and a steering link, the power steering system comprising:

a. a hydraulic cylinder having a barrel and a ram that moves into and out of one end of the barrel;

b. an actuator block that is mounted on an outer end of the ram;

c. valving that is located in the hydraulic cylinder and that is configured to control the flow of hydraulic fluid to and from the hydraulic cylinder; and d. an actuator arm that is mounted on the actuator block and that is connected to the steering link, to the steering rod, and to the valving, the actuator arm being configured to move on the actuator block upon the transmission of steering command forces thereto by the steering rod to actuate the valving so as to drive the ram into or out of the barrel and to transmit steering forces to the steering link from the actuator block, and wherein the actuator arm has a first end portion coupled to a valve actuator that actuates the valving, a central portion pivot mounted on the actuator block, a second end portion connected to the steering rod, and a steering link connector located between the first and second end portions.

10. The power steering system of claim 9, wherein the actuator block is configured such that it can accept standard steering links of different engine brands.

11. The power steering system of claim 9, wherein the actuator arm is mounted within an elongated groove in the actuator block, and wherein a clearance between the actuator arm and an edge of the groove determines the maximum pivoting stroke of the actuator arm and a resultant maximum degree of valving opening.

12. The power steering system of claim 9, further comprising a valve actuator ram, a yoke, and an actuator pin located in the actuator block, the valve actuator ram being configured to actuate the valving, the yoke engaging the actuator pin, and the actuator pin being mounted on the first end portion of the actuator arm and engaging the yoke.

13. The power steering system of claim 12, wherein an end of the valve actuator ram is attached to the yoke in an adjustable manner that allows the position of the yoke relative to the actuator arm to be adjusted after the hydraulic steering cylinder is fully assembled.

14. The power steering system of claim 9, wherein the marine steering system further comprises a swivel mount having a front end, and further comprising a universal bracket via which the hydraulic cylinder is mounted on the front end of the swivel mount, the universal bracket having mounting locations arranged to accommodate different sized and shaped swivel mounts.

15. The power steering system of claim 9, wherein a valve actuator ram is located in a bore in the actuator block and is movable under operation of the actuator arm to actuate the valving, the valve actuator ram being sealed to the bore in the actuator block by an o-ring seal.

16. The power steering system of claim 9, wherein the actuator arm has a bore formed therethrough that allows access to a nut attaching the steering rod to the actuator block, the bore having a larger diameter than a diameter of the nut.

* * * * *